US007570153B2

(12) United States Patent
Gorman et al.

(10) Patent No.: US 7,570,153 B2
(45) Date of Patent: Aug. 4, 2009

(54) SIMULTANEOUS BIDIRECTIONAL TIMING DISPLAY

(76) Inventors: Jeremy Peter Gorman, 51 Adelmide Crescent, Albany, Western Australia, 6330 (AU); John Vincent Tilbrook, 37 Mountain Road, Heathcote Junction, Victoria, 3758 (AU)

( * ) Notice: Subject to any disclaimer, the term of this patent is extended or adjusted under 35 U.S.C. 154(b) by 573 days.

(21) Appl. No.: 10/550,658

(22) PCT Filed: Mar. 26, 2004

(86) PCT No.: PCT/AU2004/000369

§ 371 (c)(1),
(2), (4) Date: Sep. 26, 2005

(87) PCT Pub. No.: WO2004/086311

PCT Pub. Date: Oct. 7, 2004

(65) Prior Publication Data

US 2006/0226959 A1 Oct. 12, 2006

(30) Foreign Application Priority Data

Mar. 28, 2003 (AU) ..... 2003901443
Jul. 3, 2003 (AU) ..... 2003903393

(51) Int. Cl.
*A63B 69/00* (2006.01)

(52) U.S. Cl. ..... 340/323 R; 340/815.66

(58) Field of Classification Search ..... 340/323 R, 340/815.67, 691.4; 368/3; 116/222
See application file for complete search history.

(56) References Cited

U.S. PATENT DOCUMENTS

| | | | | |
|---|---|---|---|---|
| 2,177,938 | A * | 10/1939 | Hamilton | 200/6 R |
| 4,578,672 | A * | 3/1986 | Oota et al. | 345/88 |
| 4,801,928 | A * | 1/1989 | Minter | 340/691.2 |
| 6,554,724 | B2 * | 4/2003 | Taylor | 473/447 |
| 2003/0109338 | A1 * | 6/2003 | Oister et al. | 473/570 |

FOREIGN PATENT DOCUMENTS

| | | |
|---|---|---|
| DE | 25 54 468 | 6/1977 |
| WO | WO 97/07484 A | 2/1997 |
| WO | WO 9707484 A2 * | 2/1997 |

OTHER PUBLICATIONS

*Patent Abstracts of Japan*, Derwent Abstract Accession No. 2003-411841/39, TO5, JP2003131596A (INDIX KK), May 9, 2003 (Abstract only).

* cited by examiner

*Primary Examiner*—Daniel Wu
*Assistant Examiner*—Ryan W Sherwin
(74) *Attorney, Agent, or Firm*—Duane Morris LLP

(57) ABSTRACT

A timing display device for use in sports such as basketball. The display includes two indicators which move in unison towards a central location. The display often includes a series of lights which give the impression of a line reducing in length over a time period.

5 Claims, 1 Drawing Sheet

SIMULTANEOUS BIDIRECTIONAL TIMING DISPLAY

FIELD OF THE INVENTION

The present invention relates to a timing display for use in sports or games such as basketball, water polo and other sports having set time limits.

BACKGROUND TO THE INVENTION

In some sports and games particular time limits apply for performing particular actions. One example of such a time limit occurs in basketball, where a team has a given period of time in which to shoot a ball after gaining possession of the ball. This time limit, which under the present rules of basketball is 24 seconds, is displayed on a device known as a "shot clock".

Known shot clocks are numerical electronic displays, which display the number of seconds remaining until the expiration of the time period. These shot clocks are typically located adjacent to a basketball court.

There are several problems associated with the use of known shot clocks. These include the need for players, coaches and spectators to focus away from the court onto the display device in order to see the remaining time period. A further problem is the propensity for the digital display device to be misread, particularly by players who read the display device using peripheral vision.

The present invention attempts to overcome at least in part some of the aforementioned disadvantages of previous timing displays.

SUMMARY OF THE INVENTION

In accordance with one aspect of the present invention there is provided a timing display device for use in games or sports, characterised in that the timing display device has a first end, a second end, and at least one intermediate location, the timing display device having a first indicating means which is arranged to move between the first end and the intermediate location, and a second indicating means which is arranged to move between the second end and the intermediate location, the first and second indicating means being arranged to move in unison towards the intermediate location such that the end of a predetermined time period is indicated by the meeting of the first and second indicating means at the intermediate location.

In accordance with a second aspect of the present invention there is provided a timing display device for use in games or sports, characterised in that the timing display device has a first end, a second end, and at least one intermediate location, the timing display device having a first indicating means which is arranged to move between an intermediate location and the first end, and a second indicating means which is arranged to move between an intermediate location and the second end, the first and second indicating means being arranged to move in unison away from a central intermediate location such that the end of a predetermined time period is indicated by the first and second indicating means reaching the first and second ends respectively.

Advantageously, this provides players, coaches and spectators with an easily viewed and understood indication of remaining time.

Preferably, each indicating means comprises a plurality of lights arranged between a respective end and the intermediate location, wherein the lights are sequentially turned off from an outermost light to a light adjacent the intermediate location, or from a light adjacent the intermediate location to an outermost light.

Preferably, lights of two colours are provided, wherein the timing device can be used to show a first time period using lights of one colour and a second time period using lights of another colour. The first and second time periods may add together to form an overall time period.

BRIEF DESCRIPTION OF THE DRAWINGS

The present invention will now be described, by way of example, with reference to the accompanying drawings, in which.

DESCRIPTION OF PREFERRED EMBODIMENTS

Figure 1:
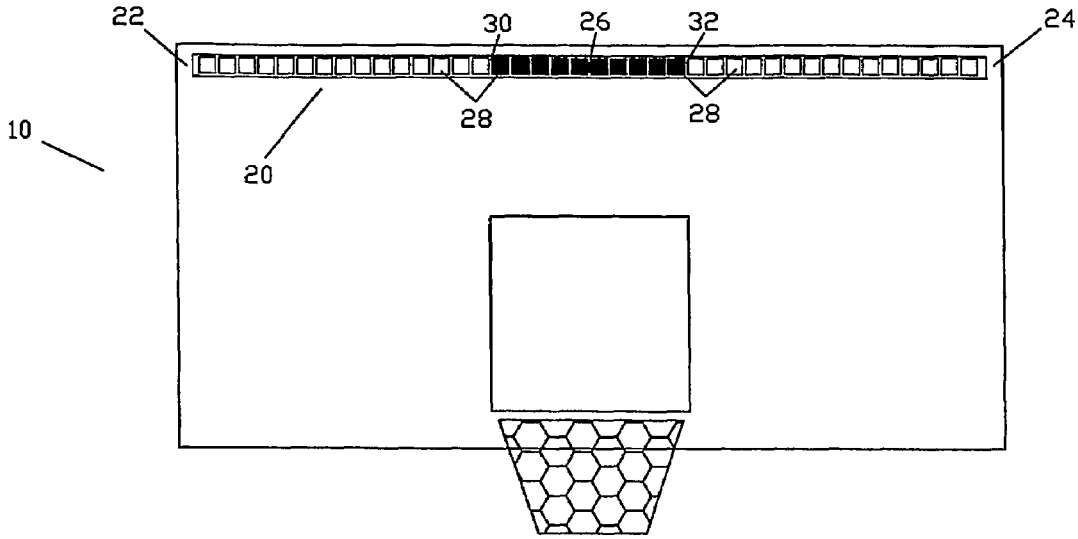
FIG. 1 is a basketball backboard incorporating a timing display device in accordance with the present invention.

Referring to the Figures, there is shown a basketball backboard 10. A timing display device 20 is mounted towards the top of the basketball backboard 10. The timing display device 20 is substantially elongate, and extends across a top edge of the basketball backboard 10. The timing display device 20 has a first end 22 and a second end 24. An intermediate location 26 is located centrally of the timing display device 20.

A plurality of indicators 28 are arranged along the timing display device 20 between the first end 22 and the second end 24. Each indicator 28 has at least an "on" state and an "off" state. In use, the timing display commences with all indicators 28 in the "on" state. As time progresses, indicators 28 starting adjacent the first and second ends 22, 24 sequentially turn "off". A first indicating means 30 is defined at the intersection between "off" and "on" indicators 28 between the first end 22 and the intermediate location 26, and a second indicating means 32 is defined at the intersection between "on" and "off" indicators 28 between the second end 24 and the intermediate location 26. As outermost "on" indicators 28 change state to "off", the first and second indicating means 30, 32 thus move in unison towards the intermediate location 26.

Figure 2:
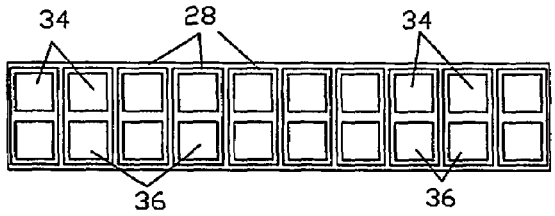
FIG. 2 is an enlarged view of a simplified embodiment of the timing display device of FIG. 1.

In a simplified embodiment of the invention, the indicators 28 each comprise a first light emitting diode 34 and a second light emitting diode 36 as shown in FIG. 2. Each of the first light emitting diodes 34 is of a first colour such as blue. Each of the second light emitting diodes 36 is of a second colour such as red.

Figure 3:
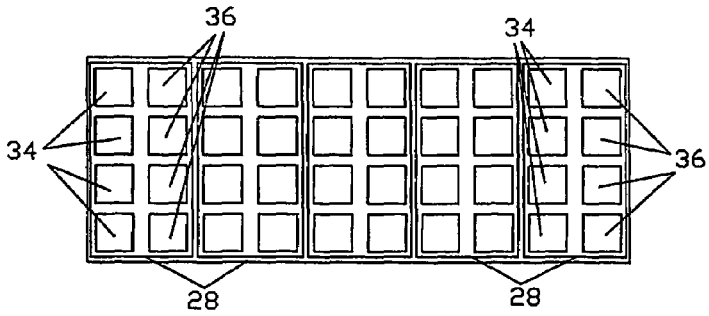
FIG. 3 is an enlarged view of an alternative embodiment of the timing display of FIG. 1.

In a preferred embodiment of the invention, as shown in FIG. 3, each indicator 28 comprises a plurality of first light emitting diodes 34 and second light emitting diodes 36.

It will be appreciated that other embodiments of the invention may have more than two diodes of different colours in each indicator.

In use, the beginning of a first time period is represented by each of the first light emitting diodes 34 being turned on. This will be perceived by a viewer as a solid blue line. As the time period progresses, the first light emitting diodes 34 will be sequentially turned off, beginning with the outermost indicators 28 and moving progressively towards the intermediate location 26. The first and second indicating means 30, 32 will thus be comprised of a series of lights which progressively turn off from the respective first and second ends 22, 24 towards the intermediate location 26. This will be perceived by a viewer as a progressive shortening of the solid blue line. The end of the first time period will be indicated by the meeting of the first and second indicating means 30, 32, being the time when the innermost first light emitting diodes 34 are turned off.

A second time period can be represented in the same way by the operation of the second light emitting diodes 36.

An overall time period such as a 24 second shot clock period may be divided into first and second time periods, for instance a 14 second first time period and a 10 second second time period. In this situation a viewer would perceive a blue line which decreases in length from both ends, with its centre remaining in a constant position, the blue line diminishing to nothing over a 14 second period and being replaced immediately by a red line which diminishes in a similar fashion over a 10 second period.

In an alternate embodiment of the invention the first and second indicating means 30, 32 move from the intermediate location 26 outwards. In this embodiment the viewer perceives lines which increase in length from the centre. In a similar embodiment (not shown), each of the first and second indicating means move from a respective intermediate location outwards, the respective intermediate locations being substantially equally displaced from a central intermediate location 26. It will be appreciated that any combination of these embodiments may be used to show sequential time periods.

It will be appreciated that other indicators 28 may be used such as light bulbs or sliding members. It will also be appreciated that indicators 28 may be arranged such that alternate indicators 28 each contain only one colour light.

In a preferred embodiment of the invention, the display device is arranged to display three consecutive 8 second periods.

It will also be appreciated that the timing display device 20 may be mounted behind the backboard 10 if the backboard 10 is transparent, or may be located at other suitable locations about the court.

In a preferred embodiment of the invention, the display device 20 is mounted such the intermediate location 26 is vertically aligned with the centre of the backboard 10. This assists a basketball player in aiming a basketball towards the goal. It will be appreciated that timing devices which do not move inwardly or outwardly from a central location may serve to distract a basketball player in the process of shooting the ball.

Where the indicators 28 are lights or light emitting diodes, it will be appreciated that the lights which are on may be arranged to flash when the time period being displayed is paused. Similarly the lights may be arranged to flash in predetermined patterns at other times in the game.

Where light emitting diodes are employed, it is considered preferable to arrange the diodes in a non-multiplexing manner. This prevents flickering problems when the display is viewed via television.

Modifications and variations as would be apparent to a skilled addressee are deemed to be within the scope of the present invention. For instance, the timing display device may be adapted for use in other sports or games.

The invention claimed is:

1. A timing display device for use in games or sports, characterized in that the timing display device has a first end, a second end, and at least one intermediate location, the timing display device having a first indicating means which is arranged to move between the first end and the intermediate location, and a second indicating means which is arranged to move between the second end and the intermediate location, the first and second indicating means being arranged to move in unison towards the intermediate location such that the end of a predetermined time period is indicated by the meeting of the first and second indicating means at the intermediate location.

2. A timing display device as claimed in claim 1, wherein in each indicating means comprises a plurality of lights arranged between a respective end and the intermediate location, wherein the lights are sequentially turned off from an outermost light to a light adjacent the intermediate location.

3. A timing display device as claimed in claim 2, wherein lights of two colours are provided, wherein the timing device can be used to show a first time period using lights of one colour and a second time period using lights of another colour.

4. A timing display device as claimed in claim 3, wherein the first and second time periods may add together to form an overall time period.

5. A method of displaying a shot clock period in basketball, wherein the method includes the step of mounting a display device as claimed in claim 1 onto a basketball backboard such that the intermediate location is vertically aligned with the centre of the backboard, and operating the timing device so as to show a period of 24 seconds.

* * * * *